United States Patent [19]

Benthin

[11] 4,361,179

[45] Nov. 30, 1982

[54] VERTICAL BLIND

[75] Inventor: Siegfried Benthin, Bremerhaven, Fed. Rep. of Germany

[73] Assignee: SUNTEC Sonnenschutztechnik GmbH, Bremerhaven, Fed. Rep. of Germany

[21] Appl. No.: 235,139

[22] Filed: Feb. 17, 1981

[30] Foreign Application Priority Data

Jul. 24, 1980 [DE] Fed. Rep. of Germany ..... 3027964

[51] Int. Cl.[3] ..... E06B 9/26

[52] U.S. Cl. ..... 160/176 R; 160/168 A

[58] Field of Search ..... 160/168, 174, 172, 176, 160/345

[56] References Cited

U.S. PATENT DOCUMENTS 3,280,891 10/1966 Eldredge, Jr. et al. ..... 160/176
3,419,065 12/1968 Johnson ..... 160/345
3,996,988 12/1976 de Wit ..... 160/168 R

*Primary Examiner*—Peter M. Caun
*Attorney, Agent, or Firm*—Michael J. Striker

[57] ABSTRACT

A vertical blind has a bearing member, a plurality of travelling carriages displaceable in the bearing member and carrying hanging members, and a plurality of brackets each at least partially surrounding the bearing member and arranged to displace along the latter together with the respective hanging member without pivoting together with the latter.

13 Claims, 6 Drawing Figures

9b
10
7b
1b
8b
6b
2b
11

VERTICAL BLIND

BACKGROUND OF THE INVENTION

The present invention relates to a vertical blind. More particularly, it relates to a vertical blind which has a horizontal bearing member, a plurality of travelling carriages displaceable relative to the bearing member in direction of elongation of the same, and a plurality of hanging members which displace together with the carriages in the direction of elongation and pivot about vertical axes.

A vertical blind of the above-mentioned general type is known in the art. The bearing member of a known vertical blind is a pipe of a rectangular cross-section with smooth outer surfaces, and the hanging members are composed of strip-shaped lamellas constituted of impregnated paper, fabric or synthetic plastic material. An outwardly actuated drive is arranged in the bearing member so as to provide for the lateral displacement of the carriages and pivot the hanging members about a vertical axis via a pivot transmission. Thereby, it is possible to pivot the hanging members in any desirable position and to displace the hanging members from their distal position to their lateral proximal position. The outer design of such a vertical blind corresponds to the modern tendencies of providing smooth outer surfaces and straight edges. The bearing member forms a decorative design element which extends transverse to the vertically extending hanging members. This bearing member cannot be covered by hanging members, and moreover a stylictic modification of the smooth surfaced bearing member has not been known.

SUMMARY OF THE INVENTION

Accordingly, it is an object of the present invention to provide a vertical blind which avoids the disadvantages of the prior art.

More particularly, it is an object of the present invention to provide a vertical blind whose decorative appearance can be attained in any desirable manner and particularly determined in dependence upon the design of the surfaces of the hanging members. A particular principle for the solution of this problem is attained by the fact that a vertical blind in accordance with the present invention can be specially designed so as to correspond to from old-fashioned up to rustic decorative styles.

In keeping with these objects and with others which will become apparent hereinafter, one features of the present invention resides, briefly stated, in a vertical blind having a substantially horizontal bearing member, a plurality of travelling carriages displaceable in direction of elongation of the bearing member, and a plurality of hanging members displacing together with the carriages and pivoting about a vertical axis, wherein a plurality of brackets is provided each surrounding the bearing member and displaceable together with the respective hanging member without pivoting together with the latter.

In accordance with another features of the present invention, the brackets or similar members are connected with the carriages in the interior of the hollow bearing member and surround pivoting members which pivot the individual hanging members.

Still another feature of the present invention is that the brackets are connected with the travelling carriages and extend together with the pivoting members surrounded thereby through a lower slot provided in a lower section of the bearing member. The pivoting members hold the hanging members and are provided with teeth forming a part of the pivot transmission, so that they simultaneously serve for holding purposes and pivoting purposes. The brackets displace together with the carriages, but do not pivot together with the hanging members. The brackets may be formed as rings or ring segments. The brackets may also have another shape, for example the shape of a bent bracket as seen in the side view.

There are bearing members which are mounted by supporting consoles on a wall or the like. In this case, the brackets surround the bearing member only partially and are interrupted at the side at which the bearing member must be mounted on the wall or the like. Thereby the supporting consoles of the bearing member do not hinder the displacement of the brackets during travelling of the carriages with the hanging members in the direction of elongation of the bearing member.

A further feature of the present invention deals with the vertical blind in which the bearing member is mounted on the supporting consoles in a position which is turned by 180° relative on the above-mentioned position. In such a construction the pivoting members extend upwardly through an upper slot provided in an upper section of the bearing member. Such a slot is invisible for an observer. The hanging members are in this case connected with the lower section of the brackets.

Still a further feature of the present invention is that means is provided for transmitting the pivoting movement of the pivoting members to the hanging members which hang on the lower sections of the brackets. This means includes a toothed portion on each pivoting member, a toothed portion on each hanging member, and a toothed segment displaceable relative to respective one of the brackets and engageable with the above-mentioned toothed portions. When the pivoting member is pivoted, the respective toothed segment is pivoted by the pivoting member and pivots, in turn, the respective hanging member. Each toothed segment displaces in the hollow interior of respective one of the brackets. Since each toothed segment engages simultaneously with the toothed portion of the pivoting member and the toothed portion of the hanging member, the pivoting of the pivoting member is directly transmitted to the hanging member.

The vertical blind in accordance with the present invention provides for a possibility to design old-fashioned and/or rustic decorative appearance. The additional important advantage of the present invention is that the brackets are arranged so that covering elements can be mounted in the region of the bearing member. Such covering elements may be constituted of the same material of which the hanging members are constituted, and overlap in scale-like member during the approaching movement of the hanging members, so as not to hinder the formation of the packet of the hanging members at their end location. Instead of the above-mentioned covering elements, other elements for advertising purposes or for improvement of the outer design can be mounted on the brackets.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
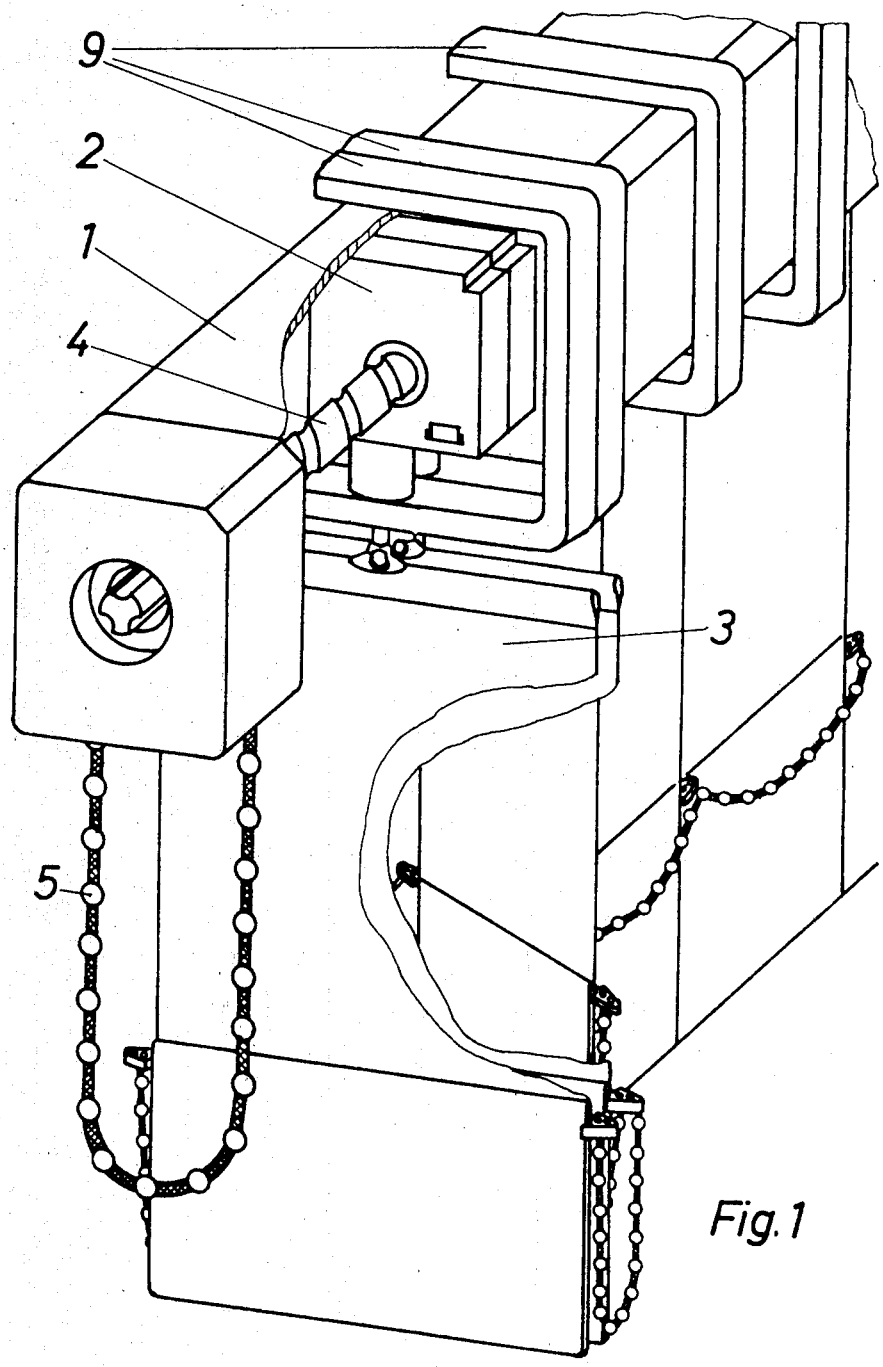
FIG. 1 is a perspective view showing a vertical blind in accordance with the present invention.

A vertical blind shown in FIG. 1 has a bearing rail or member 1, a plurality of travelling carriages 2 which travel along the bearing member 1 and are formed as rectangular tubes, and a plurality of hanging members, for example, strip-shaped lamellas 3 mounted on the travelling carriages 2.

The movement of the travelling carriages 2 in the bearing member 1 is performed with the aid of a drive element, for example, a splined shaft, a spindle shaft 4 or a simple pulling rope. It is driven by an actuating element 5, for example, a chain with ball links and the like. The pivoting movement of the hanging members 3 is performed with the aid of a pivot transmission arranged in each travelling carriage 2. The pivot transmission includes a gear 6 arranged on a pivot pin 7, and a worm gear which is connectable, for example, with the spindle shaft 4 and is not shown in the drawing.

Figure 2:
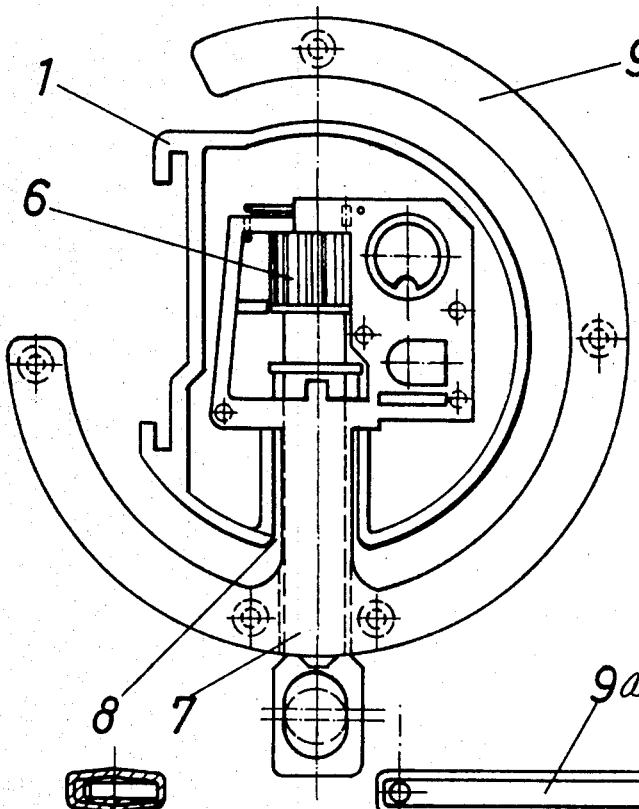
FIG. 2 is a side view of the inventive vertical blind in accordance with one embodiment of the invention.
Figure 3A:
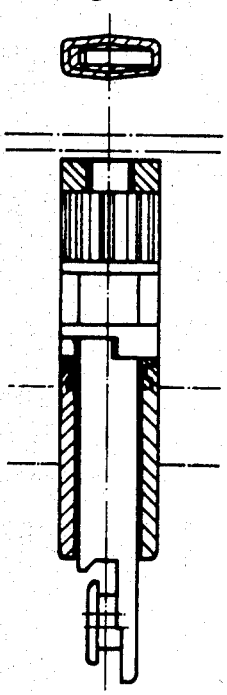
FIG. 3*a* is an axial section of the vertical blind shown in FIG. 3.
Figure 3:
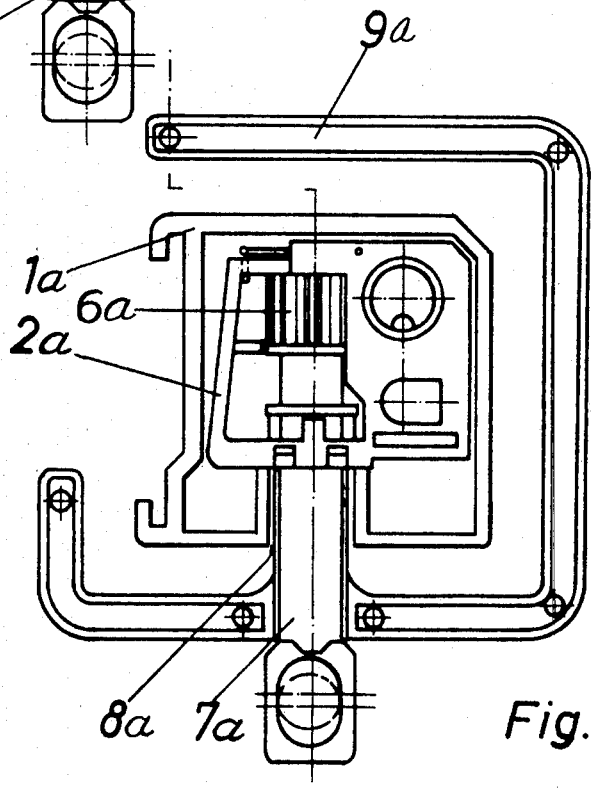
FIG. 3 is a side view of the inventive vertical blind in accordance with another embodiment of the invention.

The bearing member 1 of the vertical blind shown in FIGS. 1–3 has a slot 8 provided in the lower section of the same. The free end of the pivot pin 7 is hook-shaped and serves for hanging and fixing the hanging members 3, as shown in FIG. 1. Means for mounting the bearing member 1 is not shown in the drawing in detail and can be seen only schematically on the left surface of the bearing member 1 in FIGS. 2–4.

The vertical blind in accordance with the invention is provided with brackets which are identified by reference numeral 9. The bracket shown in FIG. 2 is formed as a ring-shaped member, whereas the bracket shown in FIG. 3 is formed as a bent member. The vertical blind of the invention has a plurality of such brackets each of which is connected with a respective of the travelling carriages 2 in the interior of the bearing member 1. More particularly, each bracket 9 has a portion which extends downwardly through the slot 8 of the bearing member 1 and surrounds the respective pivot pin 7. The cross-section of the bracket 9 is arbitrary and may correspond to any desirable appearance of the vertical blind. Each bracket 9 has a cutout or open side in the region of the rear side of the bearing member 1. This allows free movement of the brackets without being hindered by the supporting consoles for the bearing member 1.

Figure 4:
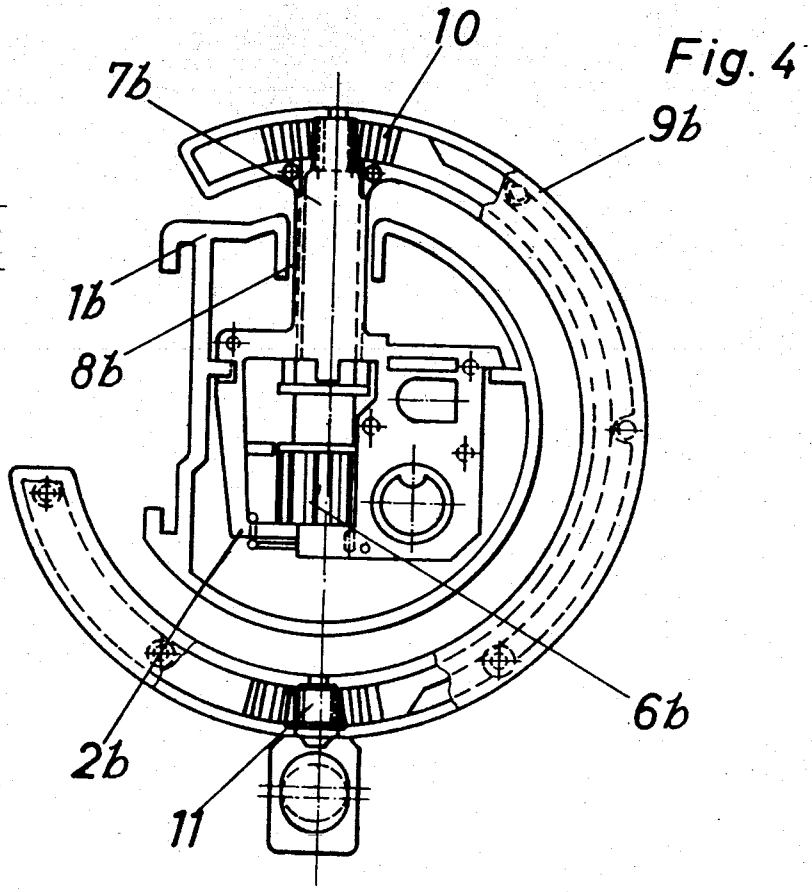
FIG. 4 is a side view of the inventive vertical blind in accordance with a further embodiment of the invention.
Figure 4A:
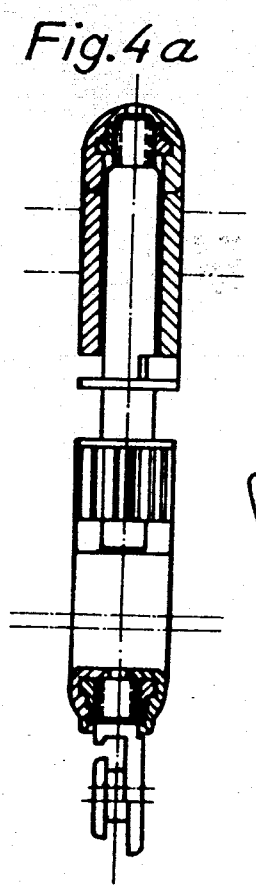
FIG. 4*a* is an axial section of the vertical blind of FIG. 4.

The vertical blind shown in FIGS. 4 and 4*a* is somewhat different from that shown in FIGS. 2, 3 and 3*a*. A bearing member 1' of the vertical blind shown in FIG. 4 is turned by 180° (as compared with the bearing member 1 of FIGS. 2, 3 and 3*a*) to obtain a different appearance of the vertical blind. The bearing member 1 has a slot 8' which in this construction is provided in an upper section of the bearing member. A pivot pin 7' extends upwardly through the upper slot 8'. Thereby an observer cannot see the slot in the bearing rail from below. In the vertical blind shown in FIGS. 2, 3 and 3*a* the pivot pin 7 serves not only as an element of the pivot transmission, but also as a supporting element which carries the hanging members. In contrast, the pivot pin 7' in the vertical blind of FIGS. 4, 4*a* is not directly connected with the hanging member. The hanging members in the vertical blind of FIGS. 4, 4*a* hang on the lower section of the respective bracket 9.

Means for transmission of the pivoting movement of the pivot pins 7 to the hanging members are provided. As can be seen from FIG. 4, the bracket 9 is hollow and has a toothed segment 10 with teeth engaging with the teeth of the pivot pin 7, on the one hand, and with the teeth of an additional pin 11, on the other hand. The pin 11 carries a respective one of the hanging members. Thereby, the pivot movement of the pivot pins 7 is synchronically transmitted via the toothed segments 2 to the respective hanging members. This embodiment clearly shows that the inventive construction of the bracket corresponds very good to the tubular construction of the bearing member. Thereby, it becomes clear that the vertical blind in accordance with the present invention can be adapted in a corresponding manner to the design of the hanging device for curtains or other hanging elements.

It will be understood that each of the elements described above, or two or more together, may also find a useful application in other types of constructions differing from the types described above.

While the invention has been illustrated and described as embodied in a vertical blind it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A vertical blind, comprising a hollow bearing member elongated in a substantially horizontal direction; a plurality of travelling carriages displacing in the interior of and relative to said bearing member in direction of elongation of the latter; a plurality of hanging members each displacing together with a respective one of said carriages in the direction of elongation of said bearing member and pivoting relative to said bearing member about a substantially vertical axis; a plurality of brackets each at least partially surrounding said bearing member, connected with a respective one of said travelling carriages in the interior of said bearing member, and being arranged so as to displace together with a respective one of said hanging members in the direction of elongation of said bearing member without pivoting together with said one hanging member; and a plurality of pivoting members each cooperating with a respective one of said travelling carriages and supporting a respective one of said hanging members for pivoting the latter about the substantially vertical axis, each of said brackets surrounding a respective one of said pivoting members in the interior of said bearing member.

2. A vertical blind as defined in claim 1, wherein each of said brackets has a first portion surrounding a respective one of said bearing members and a second portion extending into the interior of said bearing member and surrounding a respective one of said pivoting members.

3. A vertical blind as defined in claim 2, wherein said bearing member has a lower section provided with a through-going lower slot, each of said pivoting members together with the second portion of a respective one of said brackets extending through said lower slot of said bearing member.

4. A vertical blind, comprising a bearing member elongated in a substantially horizontal direction and having an upper section provided with a through-going upper slot, and a lower section; a plurality of travelling carriages displacing relative to said bearing member in direction of elongation of the latter; a plurality of hanging members each displacing together with a respective one of said carriages in the direction of elongation of said bearing member and pivoting relative to said bearing member about a substantially vertical axis; a plurality of brackets each at least partially surrounding said bearing member and being arranged so as to displace together with a respective one of said hanging members in the direction of elongation of said bearing member without pivoting together with said one hanging member; and a plurality of pivoting members each cooperating with a respective one of said carriages and arranged for pivoting a respective one of said hanging members, each of said pivoting members extending upwardly through said upper slot of said bearing member, whereas each of said hanging members hanging on the lower section of a respective one of said brackets.

5. A vertical blind as defined in claim 3; and further comprising means for transmitting the pivoting of each of said pivoting members to a respective one of said hanging members hanging on the lower section of a respective one of said brackets.

6. A vertical blind as defined in claim 5, wherein said transmitting means includes a toothed portion formed in each of said pivoting members, a toothed portion formed in each of said hanging members and a toothed segment movable relative to a respective one of said brackets and engageable with said toothed portions of a respective one of said pivoting members and hanging members, so that when one of said pivoting members is pivoted, a respective one of said segments is pivoted by said one pivoting member and pivots a respective one of said hanging members.

7. A vertical blind as defined in claim 6, wherein each of said brackets is hollow, each of said segments being movable in the interior of a respective one of said brackets.

8. A vertical blind, comprising a hollow bearing member elongated in a substantially horizontal direction; a plurality of travelling carriages arranged in the interior of and supported by said bearing member, said travelling carriages displacing relative to said bearing member in direction of elongation of the latter; a plurality of hanging members each displacing together with a respective one of said carriages in the direction of elongation of said bearing member and pivoting relative to said bearing member about a substantially vertical axis; and a plurality of brackets each at least partially outwardly surrounding said bearing member and connected with a respective one of said travelling carriages in the interior of said bearing member so as to displace together with a respective one of said hanging members in the direction of elongation of said bearing member without pivoting together with said one hanging member.

9. A vertical blind as defined in claim 8, wherein each of said carriages has a pivotable part connected and pivoting together with a respective one of said hanging members, and a non-pivotable part which does not pivot with said one hanging member and is connected with a respective one of said brackets outwardly surrounding said bearing member.

10. A vertical blind as defined in claim 9, wherein said non-pivotable part of each of said brackets extends outwardly beyond said bearing member and is connected with a respective one of said brackets.

11. A vertical blind as defined in claim 9, wherein each of said brackets has a part extending into the interior of said bearing member and connected with said non-pivotable part of a respective one of said carriages.

12. A vertical blind as defined in claim 8, wherein each of said brackets is of one piece with a respective one of said travelling carriages.

13. A vertical blind as defined in claim 8, wherein said bearing member has a mounting side at which it is mountable on a support structure, said brackets being interrupted in the region of said mounting side of said bearing member.

* * * * *